US007919019B2

(12) United States Patent
Park et al.

(10) Patent No.: US 7,919,019 B2
(45) Date of Patent: Apr. 5, 2011

(54) NANOSTRUCTURE ENHANCED LUMINESCENT DEVICES

(75) Inventors: Jason Y Park, Philadelphia, PA (US); Larry J Kricka, Devon, PA (US)

(73) Assignee: The Trustees Of The University Of Pennsylvania, Philadelphia, PA (US)

( * ) Notice: Subject to any disclaimer, the term of this patent is extended or adjusted under 35 U.S.C. 154(b) by 411 days.

(21) Appl. No.: 11/912,589

(22) PCT Filed: Apr. 26, 2006

(86) PCT No.: PCT/US2006/016249

§ 371 (c)(1),
(2), (4) Date: May 14, 2008

(87) PCT Pub. No.: WO2006/116686

PCT Pub. Date: Nov. 2, 2006

(65) Prior Publication Data

US 2008/0286856 A1 Nov. 20, 2008

Related U.S. Application Data

(60) Provisional application No. 60/675,212, filed on Apr. 27, 2005, provisional application No. 60/675,213, filed on Apr. 27, 2005.

(51) Int. Cl.
*F21K 2/06* (2006.01)

(52) U.S. Cl. ..... 252/700; 362/34; 446/219

(58) Field of Classification Search ..... 977/745–748; 362/34; 446/219; 252/700
See application file for complete search history.

(56) References Cited

U.S. PATENT DOCUMENTS

| | | | | |
|---|---|---|---|---|
| 3,974,368 | A | | 8/1976 | Rauhut |
| 4,598,044 | A | | 7/1986 | Kricka et al. |
| 4,678,608 | A | | 7/1987 | Dugliss |
| 4,729,950 | A | | 3/1988 | Kricka et al. |
| 4,857,652 | A | | 8/1989 | Schaap |
| 4,931,223 | A | * | 6/1990 | Bronstein et al. ..... 252/700 |
| 4,952,707 | A | | 8/1990 | Edwards et al. |
| 4,978,614 | A | | 12/1990 | Bronstein |
| 5,043,266 | A | | 8/1991 | Dewar et al. |
| 5,089,630 | A | | 2/1992 | Bronstein et al. |
| 5,112,960 | A | | 5/1992 | Bronstein et al. |
| 5,145,772 | A | | 9/1992 | Voyta et al. |
| 5,208,143 | A | | 5/1993 | Henderson et al. |
| 5,306,621 | A | | 4/1994 | Kricka |
| 5,523,212 | A | | 6/1996 | Akhavan-Tafti et al. |
| 5,538,847 | A | | 7/1996 | Bronstein et al. |

(Continued)

FOREIGN PATENT DOCUMENTS

WO WO 03/080756 A2 10/2003

OTHER PUBLICATIONS

Yin et al., "4-(Dimethylamino)butyric acid labeling for electrochemiluminescence detection of biological substances by increasing sensitivity with gold nanoparticle amplification", Anal Chem, Jun. 1, 2005, 77(11), 3525-3530.

(Continued)

*Primary Examiner* — David Wu
*Assistant Examiner* — Vu A Nguyen
(74) *Attorney, Agent, or Firm* — Woodcock Washburn, LLP

(57) ABSTRACT

The present invention relates to nanostructures for use in luminescent devices.

20 Claims, 4 Drawing Sheets

U.S. PATENT DOCUMENTS

| | | | | |
|---|---|---|---|---|
| 5,547,836 | A | 8/1996 | Bronstein et al. | |
| 5,552,298 | A | 9/1996 | Akhavan-Tafti | |
| 5,578,523 | A | 11/1996 | Fiordalice et al. | |
| 5,601,977 | A | 2/1997 | Akhavan-Tafti et al. | |
| 5,624,809 | A | 4/1997 | Skold et al. | |
| 5,629,168 | A | 5/1997 | Kricka | |
| 5,670,644 | A | 9/1997 | Akhavan-Tafti et al. | |
| 5,686,258 | A | 11/1997 | Akhavan-Tafti et al. | |
| 5,723,295 | A | 3/1998 | Akhavan-Tafti et al. | |
| 5,750,698 | A | 5/1998 | Akhavan-Tafti et al. | |
| 5,772,926 | A | 6/1998 | Akhavan-Tafti | |
| 5,827,650 | A * | 10/1998 | Bronstein et al. | 435/6 |
| 5,840,963 | A | 11/1998 | Akhavan-Tafti | |
| 5,849,495 | A | 12/1998 | Bronstein et al. | |
| 5,866,045 | A | 2/1999 | Akhavan-Tafti et al. | |
| 5,879,894 | A | 3/1999 | Law et al. | |
| 5,886,238 | A | 3/1999 | Schaap et al. | |
| 5,892,064 | A | 4/1999 | Schaap et al. | |
| 5,922,558 | A | 7/1999 | Akhavan-Tafti | |
| 5,938,313 | A | 8/1999 | Fujita | |
| 5,965,736 | A | 10/1999 | Akhavan-Tafti | |
| 6,045,991 | A | 4/2000 | Akhavan-Tafti | |
| 6,126,870 | A | 10/2000 | Akhavan-Tafti | |
| 6,132,956 | A | 10/2000 | Bronstein et al. | |
| 6,139,782 | A | 10/2000 | Akhavan-Tafti et al. | |
| 6,180,833 | B1 | 1/2001 | Thakur | |
| 6,218,137 | B1 | 4/2001 | Akhavan-Tafti et al. | |
| 6,245,928 | B1 | 6/2001 | Arghavani et al. | |
| 6,270,695 | B1 | 8/2001 | Akhavan-Tafti et al. | |
| 6,284,899 | B1 | 9/2001 | Schaap et al. | |
| 6,287,767 | B1 | 9/2001 | Bronstein et al. | |
| 6,296,787 | B1 | 10/2001 | Akhavan-Tafti et al. | |
| 6,306,610 | B1 | 10/2001 | Bawendi et al. | |
| 6,346,615 | B1 * | 2/2002 | Bronstein et al. | 536/26.6 |
| 6,353,129 | B1 | 3/2002 | Akhavan-Tafti et al. | |
| 6,362,011 | B1 * | 3/2002 | Massey et al. | 436/526 |
| 6,410,732 | B2 | 6/2002 | Akhavan-Tafti et al. | |
| 6,410,751 | B1 | 6/2002 | Akhavan-Tafti et al. | |
| 6,593,085 | B1 | 7/2003 | Barnett et al. | |
| 6,635,437 | B2 | 10/2003 | Akhavan-Tafti et al. | |
| 6,685,331 | B1 | 2/2004 | Rockwell | |
| 6,696,569 | B2 | 2/2004 | Akhavan-Tafti et al. | |
| 6,776,495 | B2 | 8/2004 | Nomiyama | |
| 2002/0127623 | A1 | 9/2002 | Minshull et al. | |
| 2002/0132364 | A1 | 9/2002 | Olesen et al. | |
| 2003/0077599 | A1 | 4/2003 | Sogard et al. | |
| 2003/0155560 | A1 * | 8/2003 | Palmer et al. | 252/700 |
| 2005/0118603 | A1 | 6/2005 | Chun et al. | |
| 2007/0187239 | A1 | 8/2007 | Weiller et al. | |
| 2009/0196826 | A1 | 8/2009 | Gao et al. | |
| 2009/0263914 | A1 | 10/2009 | Pettersson et al. | |
| 2010/0285972 | A1 | 11/2010 | Dubrow et al. | |

OTHER PUBLICATIONS

Martin, C.R., Nanomaterials: A Mebrane-Based Synthetic Approach, Science, 1994, 266, 1961-1966.

Hulteen et al., "A general template-based method for the preparation of nanomaterials," J. Mater. Chem., 1997, 7, 1075-1087.

Cepak, V.M. et al., "Fabrication and characterization of concentric-tubular composite micro- and nanostructures using the template-synthesis method," J. Mater. Res.., 1998, 13, 3070-3080.

Nicewarner, S.R. et al., "Submicrometer Mettalic Barcodes," Science, 2001, 294, 137-141.

Mitchell, D.T. et al., "Smart Nanotubes for Bioseparations and Biocatalysis," J. Am. Chem. Soc., 2002, 124, 11864-5.

Whitesides, G.M. et al., "Molecular Self-Assembly and Nanochemistry: A Chemical Strategy for the Synthesis of Nanostructures," Science, Nov. 29, 1991, 254(5036), 1312-1319.

Grumelard, J. et al., "Soft nanotubes from amphiphillic ABA tribloc macromonomers," Chem. Commun., 2004, 13, 1462-3.

Ghadiri, M.R. et al., "Self-assembling organic nanotubes based on a cyclic peptide architecture," Nature, 1993, 366, 424-7.

Colquoun, H.M. et al., "Microfabrication of High-performance aromatic polymers as nanotubes or fibrils by in situ ring-opening polymerization of macrocyclic precursors," J. Mater. Chem., 2003, 13, 1504-1506.

Chen et al., "Noncovalent Sidcwall Functionalization of Single-Walled Carbon Nanotubes for Protein Immobilization," J. Am. Chem. Soc., 2001, 123, 3838-9.

Baskaran, D. et al., "Polymer-Grafted Multiwalled Carbon Nanotubes through Surface-Initiated Polymerization," Agnew Chem. Int., 2004, 43, 2138-2142.

Chen, et al., "Solution Properties of Single-Walled Carbon Nanotubes," Science, 1998, 282(5386), 95-98.

Ya-Ping Sun et al., "Functionalized Carbon Nanotubes: Properties and Applications," Acc. Chem. Res., 2002, 35, 1096-1104.

Azamian et al., "Bioelectrochemical Single-Walled Carbon Nanotubes," J. Am. Chem. Soc., 2002, 124, 12664-5.

Erlanger, B.F. et al., "Binding of an Anti-Fullerene IgG Monclonal Antibody to Single Wall Carbon Nanotubes," Nano Letts, 2001, 1, 465-7.

Shim, M. et al., "Functionalization of Carbon Nanotubes for Biocompatibility and Biomolecular Recognition," Nano Letts, 2002, 2, 285-282.

Wang et al., "Ultrasensitive Electrical Biosensing of proteins an DNA: Carbon-nanotube derived amplification of the recognition and transduction events," J. Am. Chem. Soc., 2004, 126, 3010-1.

Wong, S. S. et al., Covalently functionalized nanotubes as nanometer-sized probes in chemistry and biology, Nature, 1998, 394, 52-55.

Lee et al., "Antibody-Based Bio-Nanotube Membranes for Enantiomeric Drug Separations," Science, Jun. 21, 2002, 296, 2198-2200.

Martinek, K. et al., "Micellar enzymology," Eur. J. Biochem., 1986, 155, 453-68.

Kricka, L.J. et al., "Effect of Solvents on the Catalytic Activity of Firefly Luciferase,", Arch. Biophys., 1982, 217, 674-80.

Ward, W.W. et al., "Extraction of Renilla-Type Luciferin from the Calcium-Activated Photoproteins Aequorin, Mnemiopsin, and Berovin," Proc. Natl. Acad. Sci. USA, Jul. 1975, 72(7), 2530-2534.

* cited by examiner

NANOSTRUCTURE ENHANCED LUMINESCENT DEVICES

CROSS-REFERENCE TO RELATED APPLICATIONS

This application is the National Stage of International Application No. PCT/US2006/016249 filed Apr. 26, 2006, which claims the benefit of U.S. Provisional Application No. 60/675,212, filed Apr. 27, 2005 and U.S. Provisional Application No. 60/675,213, filed Apr. 27, 2005, the disclosures of which are incorporated herein by reference in their entireties.

FIELD

The present invention relates to nanostructures for use in luminescent devices.

SUMMARY

Figure 1:
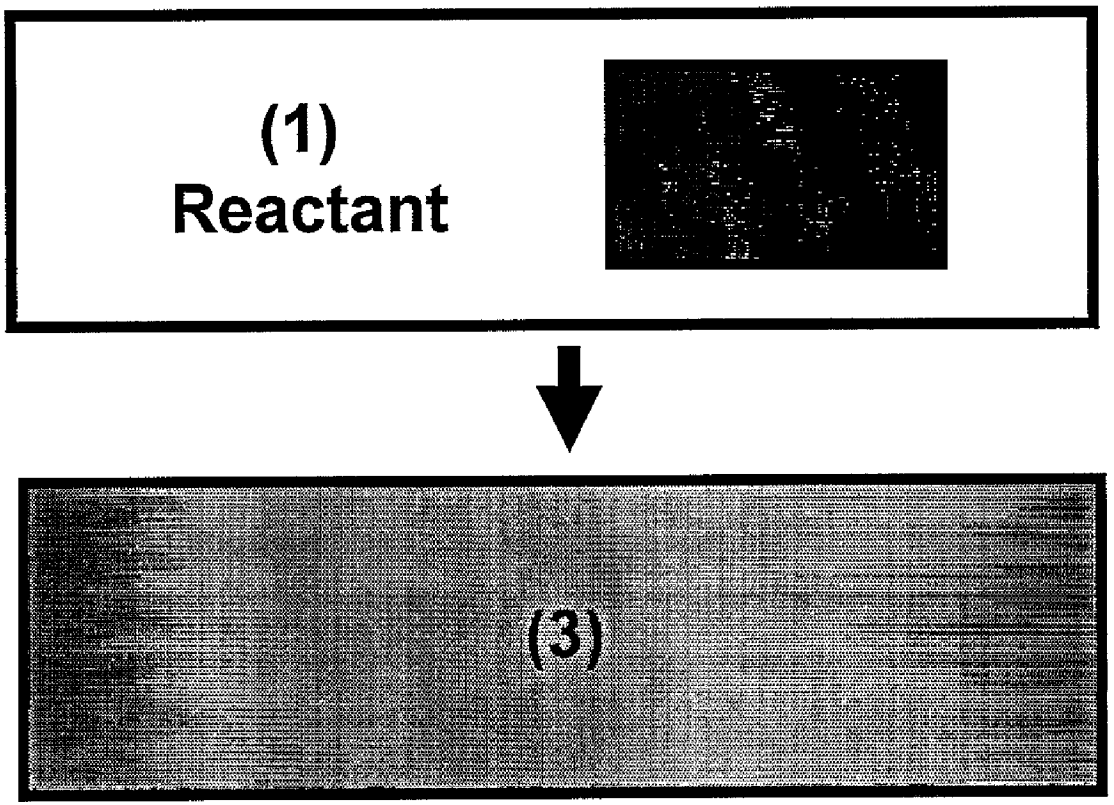
FIG. 1 is a diagrammatical representation of a representative luminescent device. The device comprises a light transmissible body defining a chamber having a capsule. The chamber contains a first luminescent reactant and the capsule contains a second luminescent reactant. At least one of the reactants is associated with nanostructure.
Figure 2:
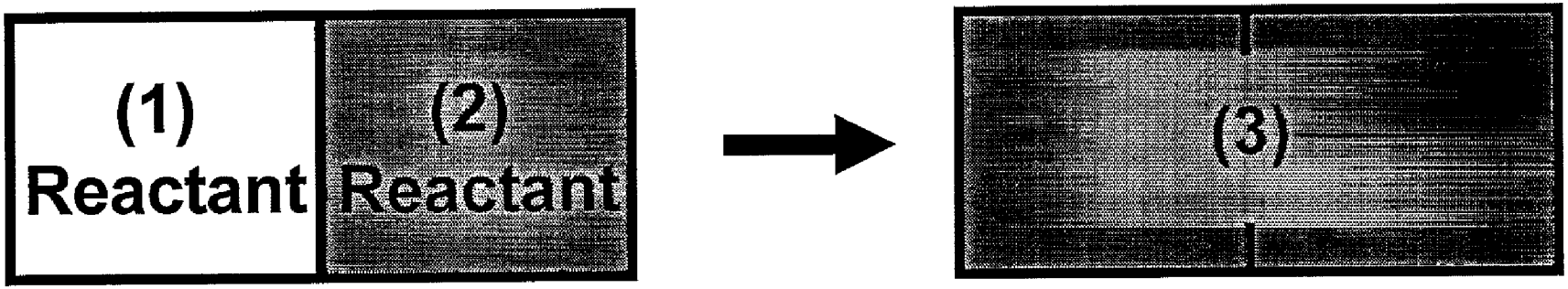
FIG. 2 is a diagrammatical representation of a representative luminescent device. The reactants are in separate holding chambers and are combined by removing a common barrier or wall. The holding chambers form a continuous chamber (3).
Figure 3:
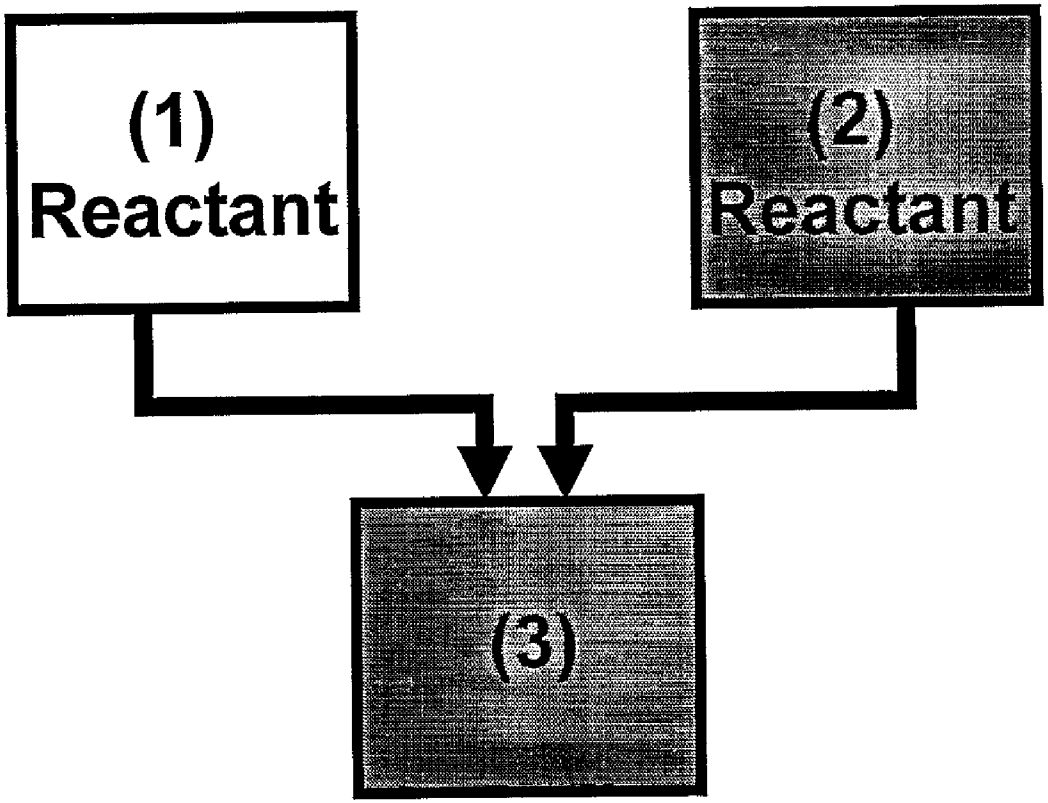
FIG. 3 is a diagrammatical representation of a representative luminescent device. The reactants are in separate holding chambers and are combined into a connected third chamber.
Figure 4:
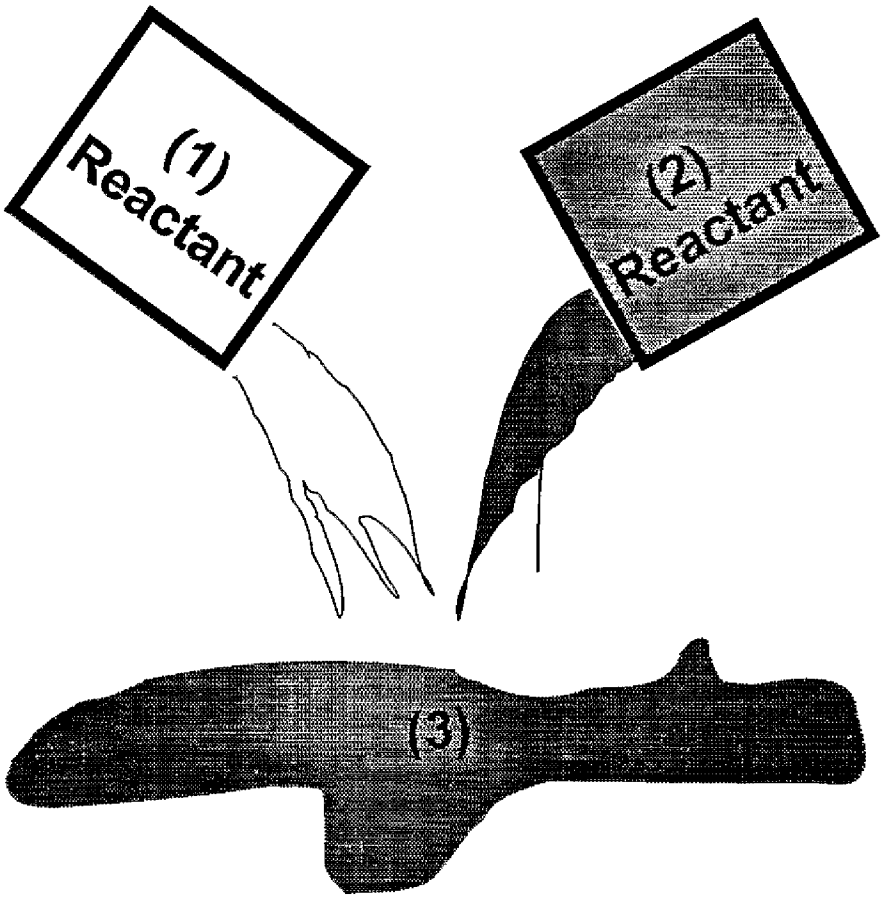
FIG. 4 is a diagrammatical representation of a representative luminescent device. The reactants are in separate chambers and are combined into a common non-attached third chamber.

This invention provides, inter alia, nanostructures associated with one or more luminescent reactant for use in luminescent devices. The luminescent devices can be used in a wide range of applications including, but not limited to, toys, light sticks (e.g., emergency lighting), and fishing goods (e.g., fishing lures).

Luminescence refers to the emission of light associated with the dissipation of energy from an electronically exited state of a substance. The term luminescent reactant as used herein refers to a protein, chemical, or other compound capable of directly or indirectly generating light.

Luminescent devices are known in the art. The use of a nanostructure associated with a luminescent reactant in such devices, however, has not been known heretofore.

Exemplary devices of the present invention comprise a light transmissible body defining a chamber, a first luminescent reactant, and a second luminescent reactant. At least one of the luminescent reactants is associated with nanostructure. The first and second luminescent reactants are physically separated from each other until such time that luminescence is desired.

In one exemplary embodiment, the chamber will contain at least one capsule that contains a luminescent reactant therein. In an exemplary embodiment, luminescence is generated when the reactant from within the capsule is released and reacts with a second reactant within the chamber. Generally, flexing the body of the device causes the luminescent reactant within the capsule to be released into the chamber, however, other means can be used to release the reactant within the chamber. In some embodiments, there will be a plurality of capsules within the device. The separate capsules can contain the luminescent reactant and the chamber can be free of reactant or alternatively the separate capsules and chamber can contain reactant.

In another exemplary embodiment, the reactants in the device can be in two or more chambers that are separated by a common wall or barrier. By removing the wall or barrier, the reactants come into contact with each other and generate luminescence. In some embodiments, the two or more chambers will be separated by a structure other than a wall or barrier, for example, tubing. By applying a force, such as negative or positive pressure, the reactant from one chamber can be forced into the other chamber thereby generating luminescence. Accordingly, the reactants can be in two or more separate chambers that are connected to a third chamber. The reactants can be added to third chamber in any order, i.e., simultaneously, sequentially, alternating or in random order and by any means including negative or positive pressure. In some embodiments the third chamber will be attached to the first and second chambers. In other embodiments, the third chamber will be a non-attached chamber. The reactant can be applied to the third chamber by any method, such as, for example, pouring, pumping, spraying or painting. The reactants can be applied simultaneously, sequentially, alternating or in any random order.

In some embodiments, the device comprises a first luminescent reactant and a second luminescent reactant physically separated from each other, but selectively deliverable to a surface on which the reactants can combine. Any surface on which the reactants can combine can be used, including, but not limited to plastic, glass and metal surfaces.

Any of the materials known in the art to make luminescent devices can be used in a device of the present invention. For example, in an exemplary embodiment, the light transmissible body and holding chambers can be made of a polymer such as polyethylene, polypropylene or the like. It will be understood that the entire body need not be light transmissible but only a portion of the body need be light transmissible. In some embodiments, the holding chamber (e.g, capsule) will be opaque so as not to degrade the luminescent reactants before the generation of luminescence. The capsule can be made up any material that can be easily broken when the body is flexed. Typically the material will be relatively brittle, such as, for example glass. In some embodiments, the device can further comprise an outer layer that covers the device. The outer layer can be a material that protects the device from unintended luminescence or breakage, e.g., plastic foam such as foamed polyethylene. The device can also further comprise a deformable configuration maintenance member within the light permeable body. The deformable configuration maintenance member can maintain the device in a preferred configuration, e.g., spiral shape, bent shape, S shape and the like. For luminescent devices known in the art, see, for example, U.S. Pat. Nos. 5,938,313; 6,776,495; 4,678,608; 3,974,368; 6,685,331; and 4,678,608 incorporated by reference in their entirety and for all purposes.

A wide variety of luminescent reactants can be employed in the present invention, including chemiluminescent and bioluminescent reactants. The bio- or chemiluminescent reactant can be any substance which causes or undergoes a chemical or biological reaction leading to the emission of light. The reactant can also be a substance which enhances a luminescent reaction.

The present invention provides a modified nanoenvironment in a luminescent device in order to enhance luminescence. The components of the nanoenvironment include a scaffold comprising molecules, organic or inorganic, arranged in a nanostructural configuration; immobilized polymers; and luminescent reactant.

Exemplary luminescent reactants of the present invention include, for example, hydrolases (e.g., phosphatases such as alkaline phosphatase); esterases; glycosidases; oxidases (e.g., peroxidases such as horseradish peroxidase and microperoxidase); luciferases (e.g., firefly luciferase), aequorin; dioxetanes, and dihydrophthalazinediones.

The term "nanostructure" as used herein refers to a scaffold comprising molecules, organic or inorganic, arranged in a nanostructural configuration. For use herein, a scaffold in nanostructural configuration is a structure that has at least one dimension that is about 100 nm or less. The scaffold can be a hollow structure such as, for example, a fullerene (e.g., buckyball), single-walled nanotube, branched nanotube, kinked or bent nanotube, multi-walled nanotube, open or closed nanotube, nanowire, nanofiber, nanochannel or any other surface or structure of nano-dimension. In addition to providing a location for the reactant and polymer, the scaffold can also provide a physical constraint surrounding the reactant and polymer.

For use herein, the terms nanotubes or nanotubules can be used interchangeably and refer to long thin hollow tubes that can have a single wall or multiple walls. The diameter of the tube is generally less than about 100 nm and the length is typically in the micrometer to centimeter range. Nanotubes have both outer and inner surfaces that can be differentially modified for chemical or biochemical functionalizations. Fullerene carbon nanotubes like regular carbon nanotubes are rolled up, highly ordered graphene sheets. Fullerene carbon nanotubes are, however, composed of more disordered forms of carbon.

The nanostructures can be constructed from a wide variety of materials, including, for example, carbon, silica, peptides, metals (e.g., palladium gold, lead zirconate titanate, and barium titanate), and organic polymers. Methods of constructing nanostructures are known in the art, for example, by pyrolytic or membrane deposition methods, by template synthesis, by wetting of porous templates or in-pore polymerization, by electroless deposition, or by sol-gel chemistry (Martin, *Science* 1994, 266, 1961-1966; Hulten et al. *J. Mater. Chem.* 1997, 7, 1075-1087; Cepak et al., *J. Mater. Res.* 1998, 13, 3070-3080; Nicewarner et al., *Science* 2001, 294, 137-141; Mitchell et al., *J Am Chem Soc* 2002; 124:11864-5) and are thus not described herein in detail.

In some embodiments, the nanostructure will be fabricated from polymers. Nanostructures, such as nanotubes, can be fabricated from polymers using any method known in the art including self assembly or template-based fabrication. Self-assembly generally refers to the designed spontaneously association of structures or aggregates by noncovalent bonds (Whitesides G M, et al. 1991). An example of self-assembly mediated production of polymer nanotubes includes the use of amphiphilic block copolymers (Grumelard et al., *Cehm Commun* 2004; 13:1462-3). Alternatively, polymer nanotubes can be fabricated from cyclic peptide monomers (Gliadiri et al., *Nature* 1993; 366:324-7). Template based fabrication can refer to the molding of a polymer or the polymerization of monomers within a solid surface to produce tube or rod-like structures (Cepak V M et al 1998; Colquhoun H M et al., *J Mater Chem* 2003; 13:1504-1506).

In alternative embodiments, the nanostructure will be fabricated from a polymer or a material other than polymers but will be polymer loaded. For use herein, a nanostructure that is polymer loaded is a nanostructure that has polymer associated with it. The polymer can be associated with the nanostructure using any means known in the art for directly or indirectly conjugating, linking, coupling or complexing molecules with each other. In some embodiments, the nanostructure will be polymer coated. The polymers are preferably immobilized on or in or around the nanostructure. Methods of immobilizing polymers on nanostructures are known in the art and can be by physical or chemical means, for example, by physical adsorption or covalent coupling.

Carbon nanostructures are inherently hydrophobic (Chen et al., *J Am Chem Soc* 2001; 123:3838-9) and this provides a means to physically immobilize other molecules onto the nanotube surface. For example, in one embodiment, the polymers will be adsorbed to carbon nanostructures simply by exposing suspensions of the nanostructures to the polymer. Alternatively, the polymer can be covalently coupled to the nanostructure, e.g., using an amino polyethylene glycol derivative. In some embodiments, carboxyl groups can be formed on the nanotubes (e.g., at the tip of a nanotube) thereby providing a site for conventional covalent attachment of biomolecules.

Silica nanostructures are inherently hydrophilic. Means for attaching molecules to silica nanostructures include, for example, attaching hydrophobic octadecyl groups to the inside of template-synthesized silica nanotubes using octadecyl silane thereby providing a hydrophobic interior to the nanotube. Alternatively, silica nanostructures can be reacted with silanes, such as, for example, aminopropyltrimethoxysilane, and the amino group can provide an attachment point for the covalent immobilization of the polymers.

Any method can be used to associate the polymer with the nanostructures to create the polymer loaded nanostructures of the present invention. For example, the covalent grafting of organic or polymeric molecules on to carbon nanotubes has been accomplished by the "grafting-to" technique by using esterification and amidation reactions (Baskaran et al., *Agnew Chem. Int.* 2004; 43:2138-2142; Chen et al., *Science* 1998; 282:95-98; Sun et al., *Acc. Chem Res.* 2002; 35: 1096-1104). Noncovalent functionalization methods have been used including polymer wrapping and "pi-pi" stacking on the surface of carbon nanotubes (Baskaran et al., *Agnew Chem. Int.* 2004; 43:2138-2142). Polymer brushes on surfaces can be produced by the growth of polymer chains from covalently attached surface initiators using the "grafting from" strategy. Surface-initiated polymerization can be used to grow polymers on silicon, gold, carbon and clay nanostructures.

In one particular example, a sample of a multi-walled nanotube (MWNT) is refluxed with 50 mL of thionyl chloride and excess thionyl chloride is removed under vacuum. The activated nanotubes (MWNT-COCl) are washed with anhydrous THF and dried under vacuum. Hydroxyethyl-2-bromoisobutyrate in toluene is added to a flask that contains MWNT-COCl and the reaction is stirred at 100° C. for about 24 h under a pure $N_2$ atmosphere. After the reaction is finished, the solvent is completely removed under vacuum, the tubes are washed several times with ethanol and filtered. The initiator-attached tubes are dried at 40° C. for 10 hr under vacuum.

In an exemplary polymerization, hydroxyethyl-2-bromoisobutyrate treated nanotubes are placed in a clean glass ampoule attached with a septum adaptor connected to both nitrogen and a vacuum system. Styrene and a solution of CuBr and ligand in toluene are added into the ampoule with a syringe under $N_2$. The entire solution is degassed four times and sealed off under vacuum. The sealed ampoule is placed in an oil bath that is maintained at 100° C. and the reaction is stirred for 24 hr. After 24 h, the reaction is quenched by cooling with liquid $N_2$ and the ampoule is opened. The heterogeneous polymerization solution is diluted with THF and kept stirring in a round bottom flask for few hours to dissolve the soluble polymer. The supernatant THF is filtered and washed with THF. The polymer grafted nanotubes are recovered as lumpy aggregates and dried (Baskaran et al., *Angew Chem. Int.* 2004; 43:2138-2142).

Immobilization of polymers to the nanostructure can be random or localized. For example, in embodiments wherein the nanostructure is a nanotube, the polymer can be randomly immobilized on the inner and outer walls of the nanotube (Azamian et al., *J Am Chem Soc* 2002; 124:12664-5; Chen et al., *J Am Chem Soc* 2001; 123:3838-9; Erlanger et al., *Nano Letts* 2001; 1:465-7; Shim et al., *Nano Letts* 2002; 2:285-82; Wang et al., *J Am Chem Soc* 2004; 126:3010-1). Alternatively, in embodiments wherein the nanostructure is a nanotube and the immobilization is selective or localized, the polymer can be localized to the tip (Wong et al., *Nature* 1998; 394:52-55) or the inner (Lee et al., *Science* 2002; 296:2198-200) or outer walls of the nanotube (Mitchell et al., *J Am Chem Soc* 2002; 124:11864-5) or even entrapped within a capped nanotube. Selective immobilization can be achieved, for example, by growing nanotubes in membrane pores (Martin, *Science* 1994; 266:1961-6). The membrane acts as a mask for the outer surface and allows selective immobilization on the inner surface of the nanotube. Selective immobilization can also be achieved by entrapment. For example, a nanotube can act as a container for enzyme labels. Generally, the size of an enzyme (e.g., alkaline phosphatase 5.77 nm×6.99 nm×11.15 nm; peroxidase 15.89 nm×15.89 nm×11.43 nm; firefly luciferase 11.95 nm×11.95 nm×9.54 nm) would restrict this to relatively large diameter nanotubes. Entrapped enzyme can move freely within the confines of the nanotube and yet be subject to the nanoenvironment created by other molecules present either in solution constrained by the nanotube pores or immobilized on the nanotube surface. In some embodiments the nanotube will be capped. Any method of capping nanotubes can be used, for example, by growing nanotubes in pores and then occluding the open end of the nanotube with glue (Martin, *Science* 1994; 266:1961-6).

The microenvironment provided by polymers and more ordered structures such as micelles has been shown to have a beneficial effect on many different types of chemical reaction (Martinek et al., *Eur J Biochem* 1986; 155:453-68). Soluble polymers can also have pronounced effects on luminescent reactions. While not wishing to be bound by any particular theory, the polymer effect may be due to one or more of the following processes—sequestration of inhibitory products (Kricka and DeLuca, *Arch Biochem Biophys* 1982; 217: 674-80), stabilization of reaction intermediates by hydrophobic regions of the polymer, creation of an environment that limits collisional deactivation of electronically excited state intermediates by solvent, or facilitating energy transfer to fluorophore acceptors added to the reaction mixture.

The term "polymer", as used herein, refers to molecules formed from the chemical union of two or more repeating units. Accordingly, included within the term "polymer" may be, for example, dimers, trimers and oligomers. The polymer may be synthetic, naturally-occurring or semisynthetic. Any polymer can be used in the present invention. Preferably the polymer will provide a more hydrophobic environment. Polymers for use in the present invention can include for example, materials that can be converted into nanofibers, such as, for example, poly(lactic acid-co-glycolic acid), poly(acrylic acid)-poly(pyrene methanol), sodium citrate, polypyrrole, poly(3-methylthiophene), polyaniline, polyacrylonitrile, poly(p-phenylene), poly(3,4-ethylenedioxythiophene), polyacrylonitrile, poly(L-lactic acid)-polycaprolactone, blends, polystyrene-block-poly(2-cinnamoylethyl methacrylate), polystyrene-block-poly(2-cinnamoylethyl methacrylate)-block-poly(tert-butyl acrylate), peptide-amphiphile, dendrimer, bolaform glucosamide; materials that can be electrospun into nanofibers, such as for example, polystyrene, polycarbonate, polymethacrylate, polyvinylchloride, polyethylene terephthalate, nylon6,6, nylon4,6, polyamide, polyurethanes, polyvinyl alcohol, polylactic acid, polycaprolactone, polyethylene glycol, polylactide-co-glycolide, polyethylene-co-vinyl acetate, polyethylene co-vinyl alcohol, polyethylene oxide, collagen; amphiphilic poly(2-methyloxazoline-block-dimethylsiloxane-block-2-methyloxazoline)(PMOXA-b-PDMS-b-PMOXA) ABA triblock copolymers; poly(thiophene); polyetherketone; polyallylamine; polyethyleneimine; poly(iminohexamethylene); polytetrafluoroethylene; poly(oxy-1,4-phenyleneoxyl-1,4-phenylenecarbonyl-1,4-phenylene); polyvinylidene fluoride; polymethyl methacrylate; polystyrene; silicon; or blends or composites thereof.

In order to create the nanostructure complexes of the present invention, a luminescent reactant is preferably associated with a polymer loaded nanostructure or a polymer fabricated nanostructure or combination thereof. For use herein, a luminescent reactant can be associated with the nanostructure using any means known in the art for directly or indirectly conjugating, linking, coupling, or complexing molecules with each other, for example, by physical, chemical or other means of attraction. In some embodiments, the reactant will be associated with the nanostructure before attachment or immobilization of a polymer to the nanostructure. The reactant can be associated with the nanostructures or polymer loaded nanostructures by physical or chemical means, for example, by physical adsorption or covalent coupling. Particularly preferred reactants of the present invention include catalytic molecules such as phosphatase enzymes (e.g., alkaline phosphatase), peroxidase enzymes (e.g., horseradish peroxidase), and luciferase enzymes (e.g., firefly luciferase).

Methods of conjugating functional groups to nanostructures are known in the art and can be used to attach reactant to nanostructure, for example, by physical adsorption, non-covalent or covalent coupling. For example, attachment of molecules onto and into carbon nanotubes can be accomplished by non-covalently attaching a reactive molecule to the sidewalls of the nanotubes. The reactive molecule can then be used to attach the molecules to a wall of the nanotube.

In one particular example, protein adsorption is carried out by immersing nanotubes in a phosphate buffer solution (pH 7) at a protein concentration of approximately 0.7 microgram/mL for 1 h followed by thorough water rinsing (Shim et al., *Nano Letts* 2002; 2:285-8). To a dispersion of oxidized nanotubes in pure water is added a dilute solution of protein. The suspension is left to stand and then tubes are washed thoroughly on a 0.4 micrometer polycarbonate membrane with HPLC-grade water. (Bioelectrochemical Single-Walled Carbon Nanotubes, Bobak et al., *J. Am. Chem. Soc.* 2002; 124: 12664-12665).

In one particular example, alkaline phosphatase is covalently coupled to carbon nanotubes by physical adsorption. (Wang et al., *J Am Chem Soc* 2004; 126:3010-1). A 0.2% Triton-X suspension containing 0.5 mg oxidized nanotubes, 100 mM MES, 100 mM NHS, and 100 mM EDAC (set to pH 6.0 with 0.1 M HCl) is sonicated for 1 h at room temperature. Following the activation, the pH is adjusted to 8.5, and the amino-modified oligonucleotides and ALP is added. The reaction mixture is stirred overnight at room temperature. Following this incubation, the mixture is washed with deionized water and 0.5M NaCl during several centrifugation cycles at 14000 rpm. Subsequently, the samples are allowed to stand at room temperature for few hours, and the supernatant fractions are collected.

A wide variety of substrates (e.g., luminescent compounds) have been identified in the art for use with luminescent assays. These include, but are not limited to, 1,2-dioxetanes, cyclic diacylhydrazide compounds, and luciferin for use with enzymes such as phosphatases (e.g., alkaline phosphatase), peroxidases (e.g., horseradish peroxidase) and luciferases (e.g., firefly luciferase).

Dioxetanes are compounds having a 4-membered ring in which 2 of the members are oxygen atoms bonded to each other. Dioxetanes can be thermally or photochemically decomposed to form carbonyl products, e.g., ketones or aldehydes. Release of energy in the form of light (i.e. luminescence) accompanies the decompositions. The dioxetanes can be used in an assay method in which a member of a specific binding pair (i.e. two substance that bind specifically to each other) is detected by means of an optically detectable reaction. According to this method, the dioxetane is contacted with an enzyme that causes the dioxetane to decompose to form a luminescent substance (i.e. a substance that emits energy in the form of light). The luminescent substance is detected as an indication of the presence of the first substance. By measuring, for example, the intensity of luminescence or the total amount of luminescence, the concentration of the first substance can be determined. Where the enzyme is an oxido-reductase (preferably a peroxidase, e.g., horseradish peroxidase or microperoxidase), it causes the dioxetane to decompose by cleaving the 0—0 bond of the 4-membered ring portion of the dioxetane. The enzyme can act directly on the dioxetane substrate or can be mediated through the addition of peroxide. Where the dioxetane includes an enzyme cleavable group (e.g., phosphate), the enzyme (e.g., phosphatase) causes the dioxetane to decompose by cleaving the enzyme cleavable group from the dioxetane. Cleavage yields a negatively charged atom (e.g., an oxygen atom) bonded to the dioxetane, which in turn destabilizes the dioxetane, causing it to decompose and emit radiation, which in turn is absorbed by the portion of the molecule containing the fluorescent chromophore, which consequently luminesces.

1,2-dioxetanes are well established in the art. Suitable dioxetanes are for example those disclosed in U.S. Pat. Nos. 4,978,614; 4,952,707; 5,089,630; 5,112,960; 5,538,847; 4,857,652; 5,849,495; 5,547,836; 5,145,772; 6,287,767; 6,132,956; 6,410,751; 6,353,129; 6,284,899; 6,245,928; 6,180,833; 5,892,064; 5,886,238; 5,866,045; 5,578,523; each of which is incorporated by reference herein in its entirety and for all purposes. In some embodiments, a hydrophobic fluorometric substrate is used in conjunction with the 1,2-dioxetane. A hydrophobic fluorometric substrate is a compound which upon activation by an enzyme can be induced to emit in response to energy transfer from an excited state dioxetane decomposition product donor. As the donor is hydrophobic, the substrate, when activated, must be sufficiently hydrophobic as to be sequestered in the same hydrophobic regions to which the donor migrates, for energy and transfer to occur. Exemplary fluorometric substrates are AttoPhos™ and AttoPhos Plus™ invented by JBL Scientific Inc. and distributed by Promega.

In general, any chemiluminescent dioxetane which can be caused to decompose and chemiluminesce by interaction with an enzyme can be used in connection with this invention. Suitable dioxetanes are available from commercial sources such as the AMPPD™, CSPD™, CDP™, and CDP™-Star substrates marketed by Tropix (Bedford, Mass.) and Lumigen PPD™, Lumi-Phos™, Lumi-Phos 530™, and Lumi-Phos Plus™, available from Lumigen Inc. (Southfield, Mich.).

Typically, the 1,2-dioxetanes useful in this invention will have the general formula:

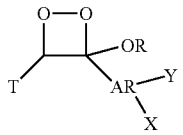

In these 1,2-dioxetanes, T is a stabilizing group. Because the dioxetane molecule, without the stabilizing group, may spontaneously decompose, a group, typically a polycycloalkyl group is bound to the dioxetane to stabilize it against spontaneous decomposition. This need for stabilization has resulted in commercially developed 1,2-dioxetanes being generally spiroadamantyl. The adamantyl group, spirobound, can be optionally substituted at any bridge head carbon, to affect chemiluminescent properties. As indicated, the remaining carbon of the dioxetane ring bears a OR substituent, wherein R is generally an alkyl or cycloalkyl, although it may be a further aryl group. The alkyl can be optionally substituted, with the substituent including halogenated groups, such as polyhaloalkyl substituents. The remaining valence is occupied by an aryl moiety, preferably phenyl or naphthyl. If naphthyl, particular substitution profiles on the naphthyl ring are preferred. The aryl ring bears at least one substituent, X. In commercially developed dioxetanes, this is typically an enzyme-cleavable group. Where the associated enzyme is alkaline phosphatase, for example, the enzyme-cleavable group X will be a phosphate. The aryl ring may also bear a substituent Y, which is selected to be either electron donating, or electron withdrawing. Preferred groups include chlorine, alkoxy and heteroaryl, although other groups may be employed. These substitutions can further effect chemiluminescent properties, and reaction kinetics. A wide variety of other substituents are disclosed in the referenced patents.

A class of compounds receiving particular attention with respect to luminescent reactions utilizing a peroxidase enzyme, e.g., horseradish peroxidase, are dihydrophthalazinedione compounds that are used in combination with an oxidant, preferably a peroxide compound such as hydrogen peroxide. Any chemiluminescent dihydrophthalazinedione can be used as substrate in the present invention, that is to say any dihydrophthalazinedione which is oxidisable in the presence of a peroxidase catalyst by an addition of an oxidant to give chemiluminescence. Dihydrophthalazinediones are well established in the art. Suitable dihydrophthalazinediones as well as other compounds for use with peroxidases, (e.g., acridinium compounds, such as acridinium esters and benzacridinium, and alkenes) are, for example, those disclosed in U.S. Pat. Nos. 5,552,298; 6,696,569; 6,410,732; 5,922,558; 5,750,698; 5,723,295; 5,670,644; 5,601,977; 5,552,298; 5,523,212; 5,879,894; 6,635,437; 6,296,787; 6,270,695; 6,218,137; 6,139,782; 6,126,870; 6,045,991; 5,965,736; 5,840,963; 5,772,926; and 5,686,258; each of which is incorporated herein by reference in its entirety. Preferred dihydrophthalazinediones include substituted aryl cyclic diacylhydrazide including aminoaryl cyclic diacylhydrazides such as luminol, isoluminol, aminobutylethylisoluminol, aminoethyl-ethylisoluminol and 7-dimethylaminonaphthalene-1,2-dicarboxylic acid hydrazide and hydroxyaryl cyclic diacylhydrazides, for example, 5-hydroxy-2,3-dihydrophthalazine-1,4-dione; 6-hydroxy-2,3-dihydro-phthalazine-1,4-dione; 5-hydroxy-2,3-dihydro-benzo[g]phthalazine-1,4-dione; and 9-hydroxy-2,3-dihydro-benzo[f]phthalazine-1,4-dione. Peroxide compounds include hydrogen peroxide, sodium perborate, urea peroxide, and the like.

The sensitivity of the peroxidase-catalyzed chemiluminescent oxidation of dihydrophthalazinediones can be enhanced by including an enhancer in the reaction. The enhancer will be present in an amount which enhances light production from the diacylhydrazide in the presence of the peroxidase and/or decreases background chemiluminescence. The enhancer can be present in the chamber or in the capsule. Enhancers are known in the art and include, phenolic compounds such as those disclosed in U.S. Pat. No. 5,306,621, incorporated herein by reference in its entirety, including p-phenylphenol, p-iodophenol, p-bromophenol, p-hydroxycinnamic acid 6-bromo-2-naphthol, D-luciferin, and 2-cyano-6-hydroxybenzothiazole as well as boronic compounds, such as those disclosed in U.S. Pat. No. 5,629,168, incorporated herein by reference in its entirety, including, 4-iodophenylboronic acid (PIBA), 4-bromophenylboronic acid (PBBA), 4-chlorophenylboronic acid, 3-chlorophenylboronic acid, 3,4-dichlorophenylboronic acid, 2,3-dichlorophenylboronic acid, 5-bromo-2-methoxybenzeneboronic acid, 3-nitrophenylboronic acid, 4-chloro-3-nitrophenylboronic acid, 3-aminophenylboronic acid, 3-amino-2,4,6-trichlorophenylboronic acid, 4-(2'-carboxyethenyl)phenylboronic acid, 1-naphthaleneboronic acid, 6-hydroxy-2-naphthaleneboronic acid, phenylboronic acid, 2-methylphenylboronic acid, 4-methylphenylboronic acid, dimethyl-phenylboronic acid, 4-bromophenyl-di-n-butoxyborane, 4-carboxy-3-nitrophenylboronic acid, 4-(trimethylsilyl)benzeneboronic acid, 4-biphenylboronic acid, 4-(phenoxy)benzeneboronic acid, 4-(3'-borono-4'-hydroxyphenylazo)benzoic acid, diphenylisobutoxyborane, 4-(4'-chloroanilino)phenylboronic acid, 4,4'-bis(phenylboronic acid), 4-(4'-bromophenyl)phenyl-di-n-butoxyborane, di(3',5'-dichlorophenoxy)-3,5-dichlorophenylborane, 4-chlorophenyl-di-(4'-chlorophenoxy)borane, pentaerythritol borate, boroglycine, 2-phenyl-1,3,2-dioxaborinane, bis (catechol)borate and 2-hydroxy-5-[(3'-trifluoromethyl)phenylazo]benzeboronic acid and diphenylboronic anhydride. Other enhancers include 6-hydroxybenzothiazole, substituted phenols, such as those disclosed in U.S. Pat. No. 4,598,044, incorporated herein by reference in its entirety; aromatic amines including those disclosed in U.S. Pat. No. 4,729,950, incorporated herein by reference in its entirety; and phenols substituted in ortho and/or para positions by imidazolyl or benzimidazolyl (U.S. Pat. No. 5,043,266, incorporated herein by reference in its entirety).

In some embodiments, the luminescent reactant will be a luciferase enzyme. Examples are luciferases isolated from a variety of luminous organisms, such as the luciferase genes of *Photinus pyralis* (the common firefly of North America), *Pyrophorus plagiophthalamus* (the Jamaican click beetle), *Renilla reniformis* (the sea pansy), and several bacteria (e.g., *Xenorhabdus luminescens* and *Vibrio* spp). Luciferases are enzymes found in luminous organisms which catalyze luminescence reactions. They are organized into groups based on commonalities of their luminescence reactions. All luciferases within a group are derived from related luminous organisms, and all catalyze the same chemical reaction. Examples are beetle luciferases, which all catalyze ATP-mediated oxidation of the beetle luciferin; and anthozoan luciferases which all catalyze oxidation of coelenterazine (Ward, 1985). With the technical capabilities of molecular biology, it is possible to alter the structure of a luciferase found in nature to yield a functional equivalent thereof. A functional equivalent is an enzyme that maintains the ability to catalyze the same luminescence reaction, and thus it remains in the same group of enzymes. Luciferase as used herein is intended to include naturally occurring and non-naturally occurring luciferase enzymes.

Luciferases generate light via the oxidation of enzyme-specific substrates, called luciferins. For firefly luciferase and all other beetle luciferases, this can be done in the presence of magnesium ions, oxygen, and ATP. For anthozoan luciferases, including *Renilla* luciferase, oxygen is typically required along with the luciferin. Additional reagents such as, for example, coenzyme A can be used to yield greater enzyme turnover and greater luminescence intensity.

It will be understood that other molecules that generate light by interaction with chemi- or bio-luminescent reactants can be used in the present invention.

The performance of luminescent reactions, such as those described herein, can be improved by use of the nanostructure complexes of the present invention. Although polymer enhancement of luminescent enzyme catalyzed reactions is known, the use of a modified nanoenvironment to enhance and better control the reaction has not been known heretofore.

Although any of the polymers disclosed herein can be used in connection with any of the luminescent reactants, certain polymers will be preferred in combination with certain reactants. For example, for use with alkaline phosphatase catalyzed reactions, preferred polymers to be immobilized on the nanostructures include polyhydroxyacrylates, polyvinyl carbamates, methacrylates, polyvinylalkylethers, polyethylenesulfonic acid, polyacrylamideomethylpropanesulfonic acid, polyvinyl alcohol, polyvinylalkylpyrrolidinones, polyvinylalkyloxazolidones, BSA, nylon, and poly[vinylbenzyl(benzyldimethyl ammonium) chloride]. While not wishing to be bound by any particular theory, it is postulated that the role of the polymer is to provide a more hydrophobic environment for decomposition of the excited electronic state intermediate formed in the scission of the 1,2-dioxetane ring structure. In an exemplary embodiment, the polymer-luminescent nanostructures will create a more ordered and/or more static nanoenvironment that will maximize polymer interactions. The enhancement effect can be improved by a tighter control of the nanoenvironment as provided by the present invention.

For use with peroxidase catalyzed reactions, preferred polymers to be immobilized on the nano structures include hydroxypropyl methylcellulose, hydroxyethyl cellulose, and hydroxybutyl methylcellulose. Boronic or phenolic enhancers are generally used in combination with the horseradish peroxidase and its substrates. A polysorbate, such as Tween 20 can also be used to stabilize light emission from the horseradish peroxidase (HRP) catalyzed chemiluminescent oxidation of hydroxyaryl cyclic diacylhydrazides.

For use with luciferase catalyzed reactions, preferred polymers to be immobilized on the nanostructures include polyethylene glycol, polyvinylpyrrolidone, and dextran. While not wishing to be bound by any particular theory, it is postulated that the polymer is acting as a reservoir for the inhibitory oxyluciferin product and the reaction and thus constantly regenerating active firefly luciferase.

Although the foregoing invention has been described in detail by way of example for purposes of clarity of understanding, it will be apparent to the artisan that certain changes and modifications are comprehended by the disclosure and can be practiced without undue experimentation within the scope of the appended claims, which are presented by way of illustration not limitation. The disclosures of all publications, patents and patent applications cited herein are hereby incorporated by reference in their entirety and for all purposes.

What is claimed:

1. A device comprising a light transmissible body defining a chamber;

a first luminescent reactant;

a second luminescent reactant;

at least one of the reactants being associated with a nanostructure, said nanostructure being loaded with polymer, fabricated from polymer, or both loaded with polymer and fabricated from polymer; and at least one of the first and second luminescent reactants being physically separated from each other, but selectively deliverable to the chamber.

2. The device of claim 1 wherein said reactants are chemiluminescent reactants.

3. The device of claim 1 wherein said reactants are bioluminescent reactants.

4. The device of claim 1 further comprising a third or fourth luminescent reactant.

5. The device of claim 1 wherein said nanostructure is both fabricated from polymer and polymer loaded.

6. The device of claim 4 wherein at least one of said reactants is alkaline phosphatase.

7. The device of claim 6 wherein said nanostructure comprises a polymer, and said polymer is poly[vinylbenzyl(benzyldimethyl ammonium)chloride].

8. The device of claim 6 wherein said nanostructure comprises a polymer, and said polymer is a polyhydroxyacrylate, polyvinyl cabamate, methacrylate, polyvinylalkylether, polyethylenesulfonic acid, polyacrylamideomethylpropanesulfonic acid, polyvinyl alcohol, polyvinylalkylpyrrolidinone, polyvinylalkyloxazolidones, BSA, or nylon.

9. The device of claim 6 wherein at least one of said reactants is a 1,2-dioxetane.

10. The device of claim 4 wherein at least one of said reactants is a peroxidase enzyme.

11. The device of claim 10 wherein said enzyme is horseradish peroxidase.

12. The device of claim 10 wherein said polymer is hydroxypropyl methyl cellulose, hydroxyethyl cellulose and hydroxybutyl methyl cellulose.

13. The device of claim 10 wherein at least one of said reactants is luminol.

14. The device of claim 4 wherein at least one of said reactants is a luciferase.

15. The device of claim 14 wherein said luciferase is firefly luciferase.

16. The device of claim 14 wherein said polymer is polyethylene glycol or polyvinylpyrrolidone or dextran.

17. The device of claim 1 wherein said nanostructure comprises carbon or silica.

18. The device of claim 17 wherein said nanostructure is a carbon or silica nanotube.

19. A device comprising a first luminescent reactant;

a second luminescent reactant;

at least one of the reactants being associated with a nanostructure, said nanostructure being loaded with polymer, fabricated from polymer, or both loaded with polymer and fabricated from polymer; and at least one of the first and second luminescent reactants being physically separated from each other, but selectively deliverable to a surface on which the reactants can combine.

20. A luminescent device comprising a light permeable body surrounding a chamber, the chamber having at least one capsule, the capsule containing a luminescent reactant;

the chamber further having a second luminescent reactant;

at least one of the reactants being associated with a nanostructure, said nanostructure being loaded with polymer, fabricated from polymer, or both loaded with polymer and fabricated from polymer.

* * * * *